US009247338B2

(12) United States Patent
Kishinami et al.

(10) Patent No.: US 9,247,338 B2
(45) Date of Patent: Jan. 26, 2016

(54) ELECTROACOUSTIC TRANSDUCER

(75) Inventors: Yuichiro Kishinami, Kanagawa (JP); Yasuharu Onishi, Kanagawa (JP); Motoyoshi Komoda, Kanagawa (JP); Nobuhiro Kawashima, Kanagawa (JP); Yukio Murata, Kanagawa (JP); Jun Kuroda, Kanagawa (JP); Shigeo Satou, Kanagawa (JP)

(73) Assignee: NEC CORPORATION, Tokyo (JP)

( * ) Notice: Subject to any disclaimer, the term of this patent is extended or adjusted under 35 U.S.C. 154(b) by 271 days.

(21) Appl. No.: 13/993,583

(22) PCT Filed: Dec. 20, 2011

(86) PCT No.: PCT/JP2011/007100

§ 371 (c)(1),
(2), (4) Date: Jun. 12, 2013

(87) PCT Pub. No.: WO2012/090433

PCT Pub. Date: Jul. 5, 2012

(65) Prior Publication Data

US 2013/0266151 A1 Oct. 10, 2013

(30) Foreign Application Priority Data

Dec. 28, 2010 (JP) ..... 2010-291871

(51) Int. Cl.
*H04R 1/22* (2006.01)
*H04R 1/34* (2006.01)
*H04R 17/00* (2006.01)

(52) U.S. Cl.
CPC ..... *H04R 1/227* (2013.01); *H04R 1/347* (2013.01); *H04R 17/00* (2013.01); *H04R 2217/03* (2013.01)

(58) Field of Classification Search
None
See application file for complete search history.

(56) References Cited

U.S. PATENT DOCUMENTS 4,875,546 A * 10/1989 Krnan ..... 181/160
5,313,525 A 5/1994 Klasco
5,675,131 A 10/1997 Saito et al.
6,807,281 B1 10/2004 Sasaki et al.
7,688,992 B2 3/2010 Aylward et al.

(Continued)

FOREIGN PATENT DOCUMENTS

CN 1933675 3/2007
CN 101282589 10/2008

(Continued)

OTHER PUBLICATIONS

Extended European Search Report dated May 9, 2014, with English Translation; Application No. 11852459.4.

(Continued)

*Primary Examiner* — Brenda Bernardi
(74) *Attorney, Agent, or Firm* — Young & Thompson

(57) ABSTRACT

There is provided an electroacoustic transducer including: an oscillation device (10) that outputs a sound wave (30) from a first vibrating surface, and outputs a sound wave (32), having an opposite phase to that of the sound wave (30), from a second vibrating surface which is opposite to the first vibrating surface; a waveguide (40) that is provided on the first vibrating surface and that includes an open end (46); a waveguide (50) that is provided on the second vibrating surface, and includes an open end (56) which faces the same direction as the open end (46); and a sound wave filter (80) that is provided in the waveguide (50) and attenuates the sound wave (32).

11 Claims, 5 Drawing Sheets

(56) References Cited

U.S. PATENT DOCUMENTS

| | | | | |
|---|---|---|---|---|
| 8,045,743 | B2 | 10/2011 | Aylward et al. | |
| 8,948,432 | B2 | 2/2015 | Tanaka et al. | |
| 2004/0173402 | A1 | 9/2004 | Morkerken | |
| 2005/0207589 | A1* | 9/2005 | Biegelsen | 381/77 |
| 2006/0182293 | A1 | 8/2006 | Sekino et al. | |

FOREIGN PATENT DOCUMENTS

| | | |
|---|---|---|
| EP | 0659030 | 6/1995 |
| JP | 64-068099 | 3/1989 |
| JP | 01-119200 | 5/1989 |
| JP | 06-098384 | 4/1994 |
| JP | 11-262084 | 9/1999 |
| JP | 2000-036993 | 2/2000 |
| JP | 2002-345077 | 11/2002 |
| JP | 2008-113194 | 5/2008 |
| JP | 2009-046236 | 3/2009 |
| TW | 201028019 | 7/2010 |
| WO | WO 2008/084806 | 7/2008 |

OTHER PUBLICATIONS

International Search Report, PCT/JP2011/007100, Jan. 31, 2012.
Chinese Office Action, dated Mar. 31, 2015, in corresponding Chinese Patent Application No. 201180061401.2.

* cited by examiner

ELECTROACOUSTIC TRANSDUCER

TECHNICAL FIELD

The present invention relates to an electroacoustic transducer using ultrasonic wave.

BACKGROUND ART

There is a piezoelectric type electroacoustic transducer known as an electroacoustic transducer used for a mobile apparatus or the like. The piezoelectric type electroacoustic transducer generates oscillation amplitude using expansion and contraction motion which is created when an electric field is applied to a piezoelectric vibrator. As a technology which relates to the piezoelectric type electroacoustic transducer, for example, there is a technology which is disclosed in Patent Document 1. This technology is used to connect a pedestal, which is used to paste up a piezoelectric element, to a support member through a vibrating membrane which has lower rigidity than the pedestal.

The piezoelectric vibrator is used for, for example, a superdirective speaker using ultrasonic wave. As a technology which relates to the superdirective speaker, for example, there are technologies disclosed in Patent Documents 2 to 5. The technology disclosed in Patent Document 2 is used to form an audible sound field at an arbitrary point in a space by controlling the phase of ultrasonic wave. The technology disclosed in Patent Document 3 is used to output ultrasonic wave in two directions, that is, a surface side and a rear surface side. The technology disclosed in Patent Document 4 relates to a superdirective speaker which combines an ultrasonic wave speaker with a wide area speaker. The technology disclosed in Patent Document 5 relates to a post for a man conveyor which includes a superdirective speaker that outputs ultrasonic wave, and a filter which attenuates the ultrasonic wave area of audible sound.

RELATED DOCUMENT

Patent Document

[Patent Document 1] Pamphlet of International Publication WO. 2008/084806

[Patent Document 2] Japanese Unexamined Patent Publication No. 2002-345077

[Patent Document 3] Japanese Unexamined Patent Publication No. 2008-113194

[Patent Document 4] Japanese Unexamined Patent Publication No. 2000-36993

[Patent Document 5] Japanese Unexamined Patent Publication No. 2009-46236

DISCLOSURE OF THE INVENTION

In sound reproduction using the electroacoustic transducer, it is possible to control the space of a reproduction area in the horizontal direction when viewed from a user but it is difficult to control the space of the reproduction area in the anterior-posterior direction.

An object of the present invention is to provide an electroacoustic transducer which enables the control of the space of a reproduction area in the anterior-posterior direction in sound reproduction when viewed from a user.

According to the present invention, there is provided an electroacoustic transducer including: an oscillation device that outputs a first sound wave from a first vibrating surface, and outputs a second sound wave, having an opposite phase to that of the first sound wave, from a second vibrating surface which is opposite to the first vibrating surface; a first waveguide that is provided on the first vibrating surface and is configured to have a first open end; a second waveguide that is provided on the second vibrating surface, and is configured to have a second open end which faces a same direction as the first open end; and a sound wave filter that is provided in the second waveguide and is configured to attenuate the second sound wave.

According to the present invention, it is possible to provide an electroacoustic transducer which enables the control of the space of the reproduction area in the anterior-posterior direction in sound reproduction when viewed from a user.

BRIEF DESCRIPTION OF THE DRAWINGS

The above-described object, the other objects, features, and advantages will become further apparent with preferred embodiments which will be described below and the accompanying drawings below.

DESCRIPTION OF EMBODIMENTS

Figure 1:
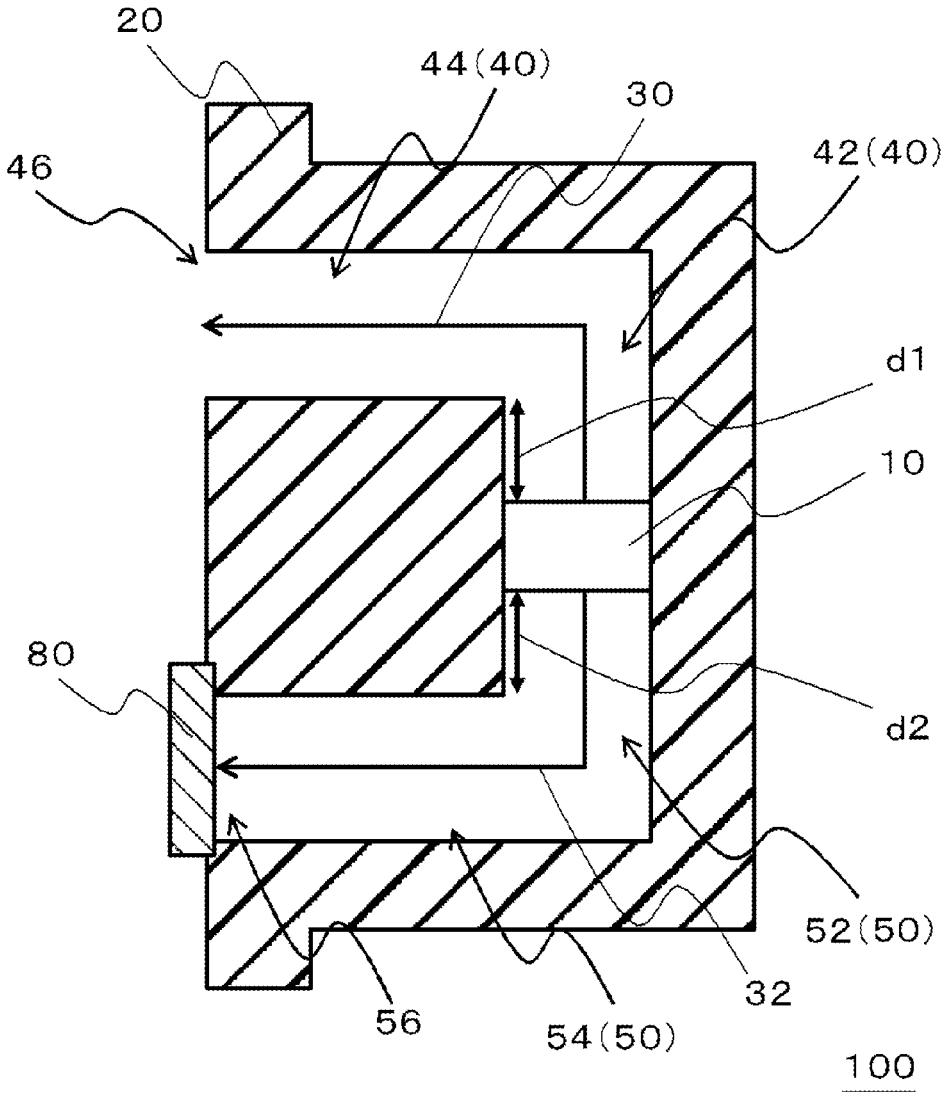
FIG. 1 is a cross-sectional view showing an electroacoustic transducer according to a first embodiment.

Hereinafter, embodiments of the present invention will be described with reference to the accompanying drawings. Also, the same reference numerals are used for the same components throughout the drawings, and the description thereof will not be repeated.

FIG. 1 is a cross-sectional view showing an electroacoustic transducer 100 according to a first embodiment. The electroacoustic transducer 100 includes an oscillation device 10, a waveguide 40, a waveguide 50, and a sound wave filter 80. The electroacoustic transducer 100 is used as a sound source of, for example, an electronic device (mobile phone, a laptop-type computer, a small game device, or the like).

The oscillation device 10 outputs ultrasonic wave 30 from a first vibrating surface. In addition, the oscillation device 10 outputs ultrasonic wave 32, which has a phase opposite to the phase of the ultrasonic wave 30, from a second vibrating surface opposite to the first vibrating surface. The waveguide 40 is provided on the first vibrating surface, and includes an open end 46. The waveguide 50 is provided on the second vibrating surface, and includes an open end 56 which faces the same direction as the open end 46. The sound wave filter 80 is provided on the waveguide 50, and attenuates the ultrasonic wave 32. Hereinafter, the configuration of the electroacoustic transducer 100 will be described in detail.

As shown in FIG. 1, the electroacoustic transducer 100 further includes a housing 20. The housing 20 includes an oscillation device 10 inside. The open end 46 and the open end 56 are provided on the surface of the housing 20.

Figure 2:
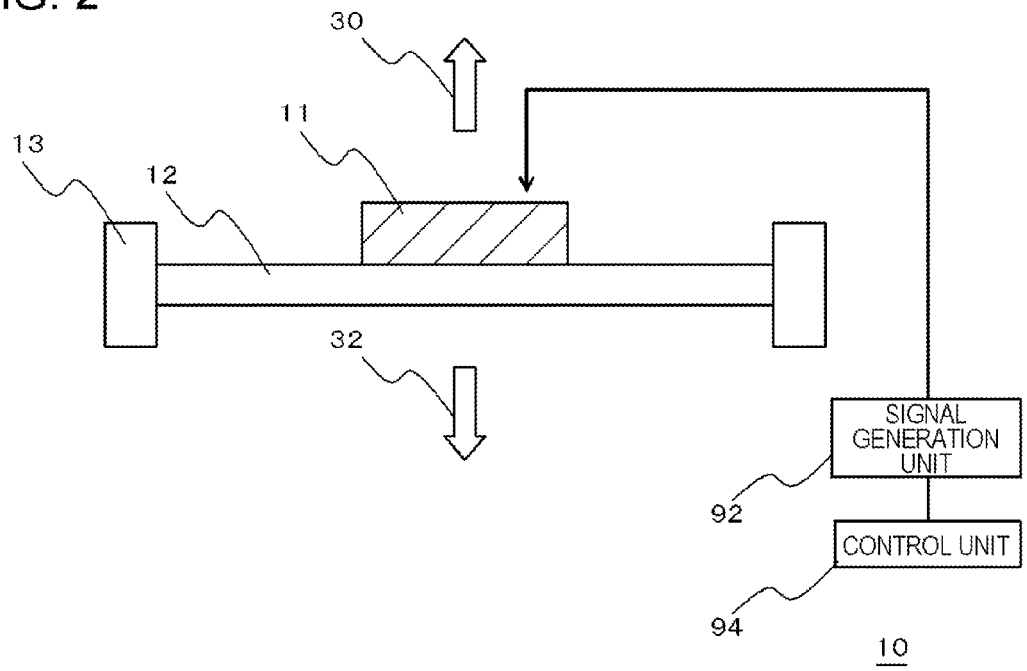
FIG. 2 is across-sectional view showing an oscillation device shown in FIG. 1.

FIG. 2 is a cross-sectional view showing the oscillation device 10 shown in FIG. 1. As shown in FIG. 2, the oscillation device 10 includes a piezoelectric vibrator 11, a vibration member 12, and a support member 13. The vibration member 12 restricts the piezoelectric vibrator 11. The support member 13 supports the vibration member 12. In addition, the oscillation device 10 includes a signal generation unit 92 and a control unit 94. The signal generation unit 92 is connected to the piezoelectric vibrator 11, and generates an electric signal to be input to the piezoelectric vibrator 11. The control unit 94 is connected to the signal generation unit 92, and controls generation of a signal by the signal generation unit 92 based on information which is input from the outside. When the oscillation device 10 is used as a speaker, information which is input to the control unit 94 is a sound signal.

The piezoelectric vibrator 11 performs an expansion and contraction motion by applying an electric field to the piezoelectric vibrator 11 in response to a signal generated by the signal generation unit 92. The vibration member 12 receives the expansion and contraction motion, and vibrates in up and down directions in the drawing. At this time, as shown in FIG. 2, the ultrasonic wave 30 is output from the first vibrating surface, and the ultrasonic wave 32 which has a phase opposite to that of the ultrasonic wave 30 is output from a second vibrating surface which is opposite to the first vibrating surface.

In the first embodiment, the oscillation device 10 is used as a parametric speaker. Therefore, the control unit 94 inputs a modulation signal as the parametric speaker through the signal generation unit 92. When the oscillation device 10 is used as the parametric speaker, the piezoelectric vibrator 11 uses a sound wave of 20 kHz or greater, for example, 100 kHz as the transport wave of a signal. In the oscillation device 10, the plural groups of piezoelectric vibrators 11 and vibration members 12 may be provided in array forms. Therefore, it is possible to improve the directionalities of the ultrasonic wave 30 and the ultrasonic wave 32 which are output by the oscillation device 10.

Figure 3:
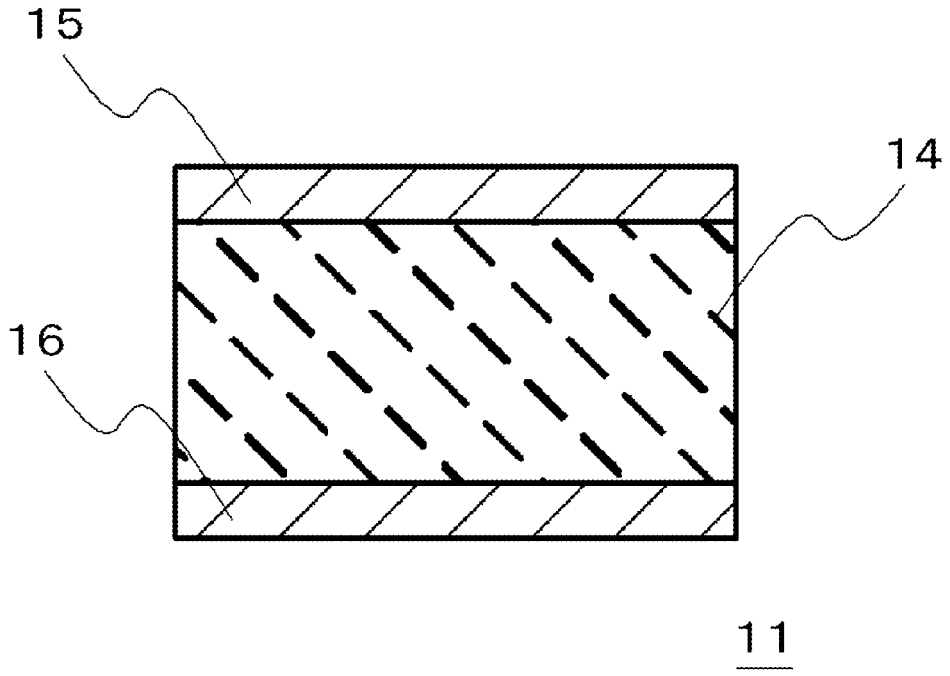
FIG. 3 is a cross-sectional view showing a piezoelectric vibrator shown in FIG. 2.

FIG. 3 is a cross-sectional view showing the piezoelectric vibrator 11 shown in FIG. 2. As shown in FIG. 3, the piezoelectric vibrator 11 includes a piezoelectric body 14, an upper electrode 15, and a lower electrode 16. In addition, the piezoelectric vibrator 11 has, for example, a circular shape, an elliptical shape, or a rectangular shape. The piezoelectric body 14 is interposed between the upper electrode 15 and the lower electrode 16. The piezoelectric body 14 is formed of a material which has piezoelectric effect, and is formed of, for example, Lead Zirconate Titanate (PZT), Barium Titanate ($BaTiO_3$), or the like. In addition, it is preferable that the thickness of the piezoelectric body 14 be 10 μm to 1 mm. If the thickness is less than 10 μm and when the piezoelectric body 14 is formed of a brittle material, the piezoelectric body 14 is easily damaged. On the other hand, when the thickness is greater than 1 mm, the intensity of the electric field of the piezoelectric body 14 is lowered, thereby causing the degradation of energy conversion efficiency.

The upper electrode 15 and the lower electrode 16 are formed of, for example, silver, silver/palladium alloy, or the like. It is preferable that the thickness of the upper electrode 15 and the lower electrode 16 is 1 to 50 μm. When the thickness is less than 1 μm, it is difficult to be uniformly formed. On the other hand, when the thickness is greater than 50 μm, the upper electrode 15 and the lower electrode 16 become restriction surfaces with regard to the piezoelectric body 14, thereby causing the degradation of energy conversion efficiency.

The vibration member 12 is formed of a material which has a high elastic modulus with regard to the ceramic material, and is formed of, for example, phosphor bronze, stainless steel, or the like. It is preferable that the thickness of the vibration member 12 be 5 to 500 μm. In addition, it is preferable that the longitudinal elastic modulus of the vibration member 12 be 1 to 500 GPa. When the longitudinal elastic modulus of the vibration member 12 is excessively low or high, there is a problem in that mechanical vibrator features and reliability may be damaged.

As shown in FIG. 1, the waveguide 40 includes an inner area 42 which configures the side of the oscillation device 10, and an outer area 44 which configures the side of the open end 46. The waveguide 50 includes an inner area 52 which configures the side of the oscillation device 10, and an outer area 54 which configures the side of the open end 56 and which is mutually parallel to the outer area 44.

The waveguide 40 is bent at a junction of the inner area 42 and the outer area 44 at a right angle. The waveguide 40 may have a curved shape on the whole which combines the inner area 42 and the outer area 44. The waveguide 50 is bent at a junction of the inner area 52 and the outer area 54 at a right angle. The waveguide 50 may have a curved shape on the whole which combines the inner area 52 and the outer area 54.

The difference d between the length of the waveguide 40 and the length of the waveguide 50 is as follows:

$$(n+3/4)\times\lambda<d<(n+5/4)\times\lambda \text{ (}n\text{ is an integer)}$$

It is possible to adjust the difference d of the length of the waveguide 40 and the length of the waveguide 50 by adjusting, for example, the position of the oscillation device 10. For example, it is possible to adjust the difference d by moving the oscillation device 10 on the side of the inner area 42 or on the side of the inner area 52. As shown in FIG. 1, when the length of the outer area 44 is equal to the length of the outer area 54 and it is assumed that the length of the inner area 42 is d1 and the length of the inner area 52 is d2, $|d1-d2|=d$.

The sound wave filter 80 is provided so as to cover the open end 56. If the ultrasonic wave 32 passes through the sound wave filter 80, the sound pressure of the ultrasonic wave 32 attenuates. It is possible to appropriately change the thickness of the sound wave filter 80 in conformity with the space control of the reproduction area which will be described later.

Subsequently, the principle of the operation of the parametric speaker will be described. The principle of the operation of the parametric speaker is to reproduce sound using a principle in which audible sounds emerge based on non-linear characteristics obtained when ultrasonic wave, on which AM modulation, DSB modulation, SSB modulation, or FM modulation is performed, is emitted into the air and the ultrasonic wave propagates in air. Here, the non-linearity means that laminar flow moves to turbulent flow if Reynolds number which is indicated by a ratio of inertial action to viscous action of the flow becomes large. That is, since the sound waves are infinitesimally disturbed in fluid, the sound waves propagate in non-linear manner. In particular, when ultrasonic wave is emitted in air, harmonics are significantly generated in accordance with the non-linearity. In addition, sound waves are in a dense state in which molecular groups in air are mixed in the concentration. When it takes further time to restore air molecules than to compress the air molecules, the air which is difficult to be restored after being compressed come into collision with air molecules which propagate in a continuous manner, and thus shock waves are generated and audible sounds are generated. The parametric speaker can form a sound field only in the vicinity of a user, and thus it is excellent in a viewpoint of the protection of privacy.

Figure 4:
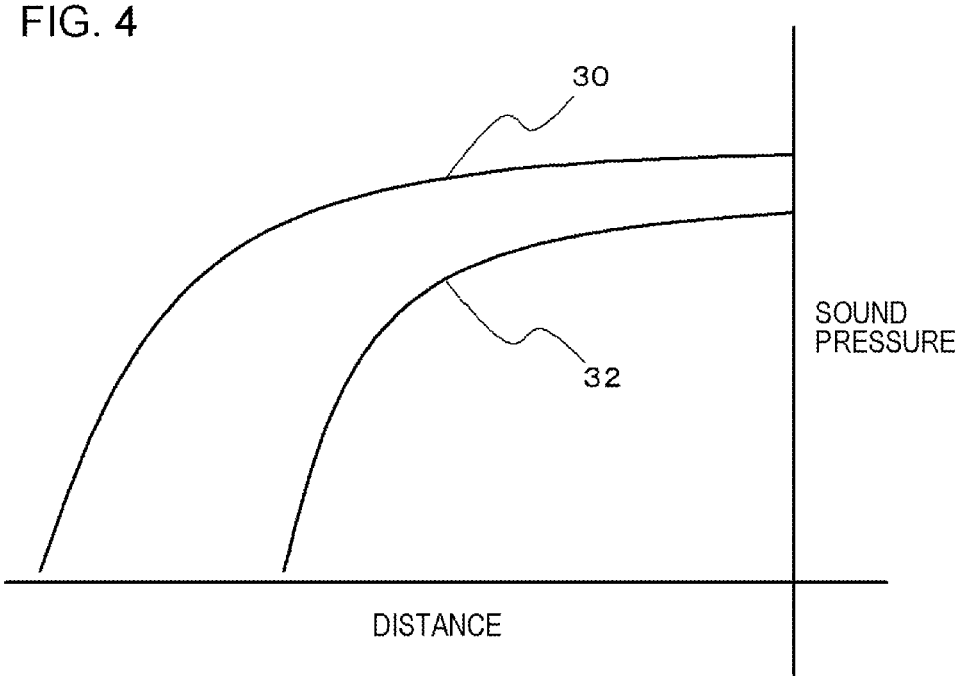
FIG. 4 is a graph showing a principal of sound reproduction performed by the electroacoustic transducer shown in FIG. 1.

Subsequently, a principle in which the space control of the reproduction area can be performed in the sound reproduction by the electroacoustic transducer 100 according to the first embodiment will be described. FIG. 4 is a graph showing the principle of the sound reproduction performed by the electroacoustic transducer 100 shown in FIG. 1. The electroacoustic transducer 100 outputs the ultrasonic wave 30 from the first vibrating surface of the oscillation device 10 toward the waveguide 40. Therefore, a sound field is formed in an area which is located in the direction to which the open end 46 of the waveguide 40 faces. In addition, the electroacoustic transducer 100 outputs the ultrasonic wave 32 from the second vibrating surface of the oscillation device 10 toward the waveguide 50. Therefore, a sound field is formed in an area which is located in the direction to which the open end 56 of the waveguide 50 faces. The ultrasonic wave 30 and the ultrasonic wave 32 progress in the space while having high directionality and being a quantity of widespread. Therefore, the ultrasonic wave 30 and the ultrasonic wave 32, which are respectively output from the open end 46 and the open end 56 facing the same direction and which progress in parallel to each other, interfere with each other.

On the other hand, in the electroacoustic transducer 100, the ultrasonic wave 30 and the ultrasonic wave 32, each having a wavelength λ, are respectively emitted from the first vibrating surface and the second vibrating surface, which is formed on the opposite surface of the first vibrating surface included in the oscillation device 10. Therefore, the ultrasonic wave 30 and the ultrasonic wave 32 have opposite phases. That is, the phases of the ultrasonic wave 30 and the ultrasonic wave 32 are shifted by λ/2. Here, the difference d between the length of the waveguide 40 and the length of the waveguide 50 is as follows:

$$(n+3/4)\times\lambda<d<(n+5/4)\times\lambda (n \text{ is an integer}).$$

Therefore, when the ultrasonic wave 30 comes into collision with the ultrasonic wave 32, the ultrasonic wave 30 and the ultrasonic wave 32 interfere with each other, and become extinct with each other or weaken with each other.

Here, as shown in FIG. 4, ultrasonic wave rapidly attenuates in a predetermined distance. In addition, the distance till the ultrasonic wave gets attenuated is long or is short depending on the sound pressure of the ultrasonic wave. That is, as the sound pressure of the ultrasonic wave is high, the ultrasonic wave rapidly attenuates in a further distance. In the first embodiment, since the ultrasonic wave 32 passes through the sound wave filter 80 which is provided in the waveguide 50, the sound pressure of the ultrasonic wave 32 attenuates at a stage in which the ultrasonic wave 32 is output to the outside of the electroacoustic transducer 100. Therefore, as shown in FIG. 4, the ultrasonic wave 32 rapidly attenuates in a location which is near the electroacoustic transducer 100, compared to the ultrasonic wave 30. Therefore, in a space till the ultrasonic wave 32 gets attenuated, the ultrasonic wave 30 and the ultrasonic wave 32 interfere with each other, and become extinct with each other or weaken with each other. As described above, it is possible to control sound pressure in a space up to a predetermined distance from the electroacoustic transducer 100. In addition, only the ultrasonic wave 30 proceeds in a backward space of the location in which the ultrasonic wave 32 attenuates. Therefore, in a backward space of the location in which the ultrasonic wave 32 attenuates, sound having excellent sound pressure is reproduced.

When reproduction sound pressure becomes extinct in a space from the electroacoustic transducer 100 to the location in which the ultrasonic wave 32 attenuates, it is further preferable that the difference d between the length of the waveguide 40 and the length of the waveguide 50 be as follows:

$$d=n\lambda (n \text{ is an integer}).$$

In addition, the difference d between the length of the waveguide 40 and the length of the waveguide 50 can take other number ranges, for example, the difference d can be as follows:

$$(n+1/4)\times\lambda<d<(n+3/4)\times\lambda (n \text{ is an integer}).$$

In this case, the ultrasonic wave 30 and the ultrasonic wave 32 reinforce with each other. Therefore, in the space from the electroacoustic transducer 100 to the location in which the ultrasonic wave 32 attenuates, the reproduction sound pressure is increased.

Subsequently, the advantage of the first embodiment will be described. According to the electroacoustic transducer 100 according to the first embodiment, the ultrasonic wave 30 and the ultrasonic wave 32 which have inverse phases from each other are respectively output from the open end 46 and the open end 56 which face the same direction. In addition, the sound wave filter 80 is provided in the waveguide 50. Therefore, it is possible to control sound pressure in the space from the electroacoustic transducer 100 to the location in which the ultrasonic wave 32 attenuates. In addition, in the backward space of the location in which the ultrasonic wave 32 attenuates, sound having excellent sound pressure is reproduced. Therefore, in sound reproduction, it is possible to control the space of the reproduction area in an anterior-posterior direction when viewed from the user.

Figure 5:
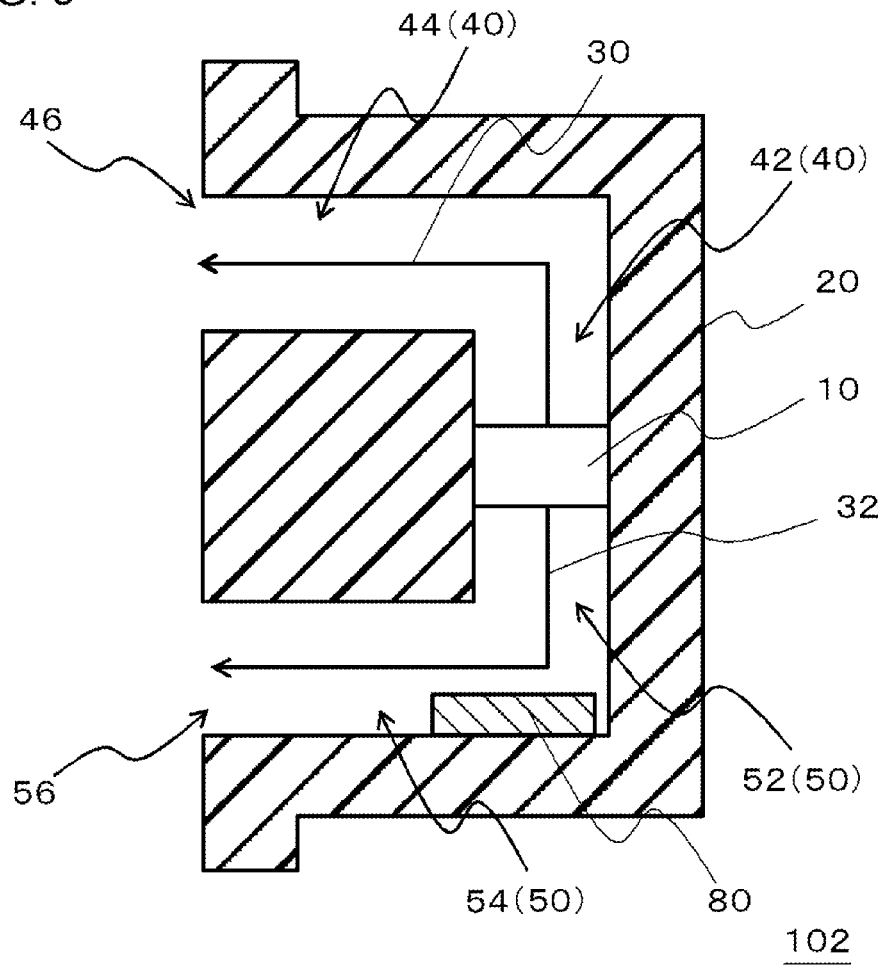
FIG. 5 is a cross-sectional view showing an electroacoustic transducer according to a second embodiment.

FIG. 5 is a cross-sectional view showing an electroacoustic transducer 102 according to a second embodiment, and corresponds to FIG. 1 according to the first embodiment. The electroacoustic transducer 102 according to the second embodiment is the same as the electroacoustic transducer 100 according to the first embodiment excepting that the sound wave filter 80 is provided on the inner wall of the waveguide of the waveguide 50.

Although not shown in the drawing, the ultrasonic wave 32 is output from the open end 56 while coming into collision with the inner wall of the inner area 52 or the inner wall of the outer area 54. Therefore, even though the sound wave filter 80 is provided on the inner wall of the waveguide 50, the sound pressure of the ultrasonic wave 32 attenuates.

In the second embodiment, the same advantage as that of the first embodiment can be obtained.

Hereinbefore, although the embodiments of the present invention have been described with reference to the drawings, they are examples of the present invention, and various configurations other than above can be used.

This application claims a right of priority based on Japanese Patent Application No. 2010-291871 which is applied on Dec. 28, 2010, and involves all of the disclosure herein.

The invention claimed is:

1. An electroacoustic transducer, comprising:

an oscillation device that outputs a first sound wave from a first vibrating surface, and outputs a second sound wave, having an opposite phase to that of the first sound wave, from a second vibrating surface which is opposite to the first vibrating surface;

a first waveguide that is provided on the first vibrating surface and is configured to have a first open end;

a second waveguide that is provided on the second vibrating surface, and is configured to have a second open end which faces a same direction as the first open end; and a sound wave filter that is provided in the second waveguide and is configured to attenuate the second sound wave, wherein each of the first sound wave and the second sound wave are transport waves and are ultrasonic, wherein a difference d between a length of the first waveguide and a length of the second waveguide is $$(n+3/4)\times\lambda<d<(n+5/4)\times\lambda$$

where n is an integer, and λ is a wavelength of the transport wave, and wherein a position of the oscillation device is adjustable in a direction from one to the other of the first waveguide to the second waveguide.

2. The electroacoustic transducer according to claim 1, wherein the difference d between the length of the first waveguide and the length of the second waveguide is $$d=n\lambda,$$

where n is an integer, and λ is a wavelength of the transport wave.

3. The electroacoustic transducer according to claim 1, further comprising:

a signal generation unit that is connected to the oscillation device; and a control unit that is connected to the signal generation unit, and controls generation of a signal by the signal generation unit.

4. The electroacoustic transducer according to claim 1, wherein the sound wave filter is provided to cover the second open end.

5. The electroacoustic transducer according to claim 1, wherein the sound wave filter is provided on an inner wall of the second waveguide.

6. The electroacoustic transducer according to claim 1, wherein the first waveguide includes a first inner area which configures the side of the oscillation device, and a first outer area which configures the side of the first open end, and the second waveguide includes a second inner area which configures the side of the oscillation device, and a second outer area which configures the side of the second open end and which is mutually parallel to the first outer area.

7. The electroacoustic transducer according to claim 1, further comprising:

a housing that includes the oscillation device inside, wherein the first open end and the second open end are provided on a surface of the housing.

8. An electronic apparatus, comprising:

an electroacoustic transducer, wherein the electroacoustic transducer includes an oscillation device that outputs a first sound wave from a first vibrating surface, and outputs a second sound wave, having an opposite phase to that of the first sound wave, from a second vibrating surface which is opposite to the first vibrating surface;

a first waveguide that is provided on the first vibrating surface and is configured to have a first open end;

a second waveguide that is provided on the second vibrating surface, and is configured to have a second open end which faces a same direction as the first open end; and a sound wave filter that is provided in the second waveguide and is configured to attenuate the second sound wave, wherein each of the first sound wave and the second sound wave are transport waves and are ultrasonic, wherein a difference d between a length of the first waveguide and a length of the second waveguide is $$(n+3/4)\times\lambda<d<(n+5/4)\times\lambda$$

where n is an integer, and λ is a wavelength of the transport wave, and wherein a position of the oscillation device is adjustable in a direction from one to the other of the first waveguide to the second waveguide.

9. The electroacoustic transducer according to claim 2, further comprising:

a signal generation unit that is connected to the oscillation device; and a control unit that is connected to the signal generation unit, and controls generation of a signal by the signal generation unit.

10. The electroacoustic transducer according to claim 2, wherein the sound wave filter is provided to cover the second open end.

11. The electroacoustic transducer according to claim 3, wherein the sound wave filter is provided to cover the second open end.

* * * * *